United States Patent [19]

Pollich

[11] Patent Number: 4,479,645

[45] Date of Patent: Oct. 30, 1984

[54] SHEET DELIVERER FOR ROTARY PRINTING MACHINES

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 363,117

[22] Filed: Mar. 29, 1982

[30] Foreign Application Priority Data

Apr. 4, 1981 [DE] Fed. Rep. of Germany ..... 3113750

[51] Int. Cl.[3] ..... B65H 29/04; B65H 29/24; B65H 29/68

[52] U.S. Cl. ..... 271/183; 271/195; 271/204

[58] Field of Search ..... 271/204, 205, 206, 183, 271/182, 195, 211

[56] References Cited

U.S. PATENT DOCUMENTS

| | | | |
|---|---|---|---|
| 2,969,980 | 1/1961 | Claybourn | 271/183 |
| 3,378,256 | 4/1968 | Ellis et al. | 271/183 |
| 3,779,545 | 12/1973 | Schuhmann et al. | 271/183 |
| 3,933,351 | 1/1976 | Mayer et al. | 271/183 |
| 4,083,556 | 4/1978 | Schilling et al. | 271/204 |
| 4,085,930 | 4/1978 | Weisgerber et al. | 271/204 |
| 4,225,129 | 9/1980 | Zimmermann et al. | 271/204 |

FOREIGN PATENT DOCUMENTS

| | | | |
|---|---|---|---|
| 215367 | 4/1924 | United Kingdom | 271/79 |

*Primary Examiner*—Duane A. Reger
*Assistant Examiner*—James E. Barlow
*Attorney, Agent, or Firm*—Cushman, Darby & Cushman

[57] ABSTRACT

A sheet deliverer adapted for use with rotary printing machines includes a continuous chain having gripping members carried thereon for gripping the leading edge portions of printed sheets and delivering the printed sheets to a product collection site, at least the downstream section of the continuous chain being substantially horizontally disposed above the product collection site. Guide yokes are provided to supplement a developed air cushion on the undersides of the printed and are adjustable so as to contact the printed sheets only at the print-free margins thereof to prevent destruction of the printed portions of the sheets during conveyance.

16 Claims, 8 Drawing Figures

SHEET DELIVERER FOR ROTARY PRINTING MACHINES

BACKGROUND AND SUMMARY OF THE INVENTION

The present invention relates to a novel sheet deliverer for rotary printing machines having gripper members carried by continuous chains and braking rollers acting on the underside of the sheet positioned directly upstream of a delivery pile. Upstream of the delivery pile and braking rollers, there are arranged blower nozzles which direct an airstream of adjustable velocity against the underside of the sheet being guided by the gripper members in a direction opposed to the sheet delivery direction.

A conventional sheet deliverer of the type roughly described above has been proposed in DE-AS No. 1,148,241. Directly ahead of the braking rollers, a blast pipe having several blower nozzles extends across the sheet deliverer below the chain path. An airstream is delivered from the blower nozzles in a direction opposed to the sheet delivery direction and is directed at a very acute angle against the underside of the approaching sheet. The airstream leaving the blower nozzles causes a drop in the static pressure on the underside of the sheet and creates an air cushion between the sheet guide table and the sheets transported by the chain grippers. The reduction of static pressure on the underside of the sheet causes reliable contact between the sheet underside and the braking rollers. However, the sheet underside slides over the blower nozzle pipe and in the case of double-sided sheet printing, such as in the perfecting process, smearing of the fresh print on the sheet underside is an unavoidable consequence.

Another conventional sheet deliverer, described in DE-AS No. 2,135,105, has braking nozzle strips arranged upstream of the delivery pile, extending across the sheet width and directed against the sheet movement approximately parallel to the sheet path. On the approach side of the sheet, the braking nozzle strips have a horn-shaped bent guide plate under the sheet conveyor line, with lower part being bent downwards and arranged widthwise. The air leaving the braking nozzle strips acts on the underside of the approaching sheet drawing it down onto the braking nozzle strips. Due to the powerful braking effect, secondary grippers are provided which pull the sheet over and off the braking nozzle strips after the leading sheet edge has been released by the gripper members carried by the chain deliverer. With such a conventional sheet deliverer, the sheet is retarded and tensed when deposited on the top of the delivery pile. However, a disadvantage here again is that the braking nozzle strips tend to smear print on the sheet underside. The sheet deliverer according to DE-AS No. 2,135,105 is, therefore, only suitable for use on rotary printing machines which operate on the principle of face printing.

Another conventional configuration of a sheet deliverer is shown by DE-AS No. 2,544,566. The path of the delivery chain is designed with an inclined rising section and a horizontal section extending over the delivery pile. A sheet guide plate is arranged under the inclined rising section and part of the horizontal section of the delivery chain to produce an uninterrupted air cushion extending to the braking rollers. This type of conventional sheet deliverer is of a two-section design with the front edge of the sheet guide plate section, which is nearest to the delivery pile, securely mounted to the braking roller. When making format settings on the braking roller, the adjustable part of the sheet guide plate is also set.

As already mentioned above, such a conventional type of sheet deliverer provides an air cushion above the sheet guide surface extending as far as the braking rollers. However, even with such a conventional sheet deliverer, it is not possible to fully exclude the possibility of blotting the fluttering sheet. Thus, in order to ensure that the back section of the transported sheet also contacts the braking rollers, it is necessary, at least at high sheet conveying speeds—for example 8000 sheets per hour—to provide blowers above both the rising and the horizontal section of the delivery chain to ensure that the transported sheet is pressed onto the braking rollers. However, even with such a blower arrangement, the sheet may be passed onto the sheet guide plate and, thus, smeared.

Often, the blowers must powerfully operate at high velocities to press the back sheet end down. The air supplied by these blowers will then also enter the space between the next approaching sheet and the sheet guide plate. The air cushion generated by the sheet conveying speed is increased considerably by this occurrence, leading in turn to the sheet being pressed up or at least to fluttering of the sheet end at certain sheet conveying speeds. Such disturbed sheet feeding requires a further increase in the blower power, to ensure that the sheet end is pressed down. However, this results in even more air entering under the next approaching sheet. The consequences of such occurrences is that the power of the blowers blowing onto the topside of the sheet as well as the conveying power of the chain deliverer must be reduced considerably to return to a state of reliable delivery.

The object of the present invention, however is to avoid the disadvantages of the above-mentioned conventional sheet deliverers. It is a primary object of the present invention to guarantee that, for all sheet conveying speeds, the back end of the sheet guided by the gripper members of a chain deliverer is reliably drawn onto the braking rollers and that it is possible to set the entire sheet braking and guidance system to act on print-free parts of, for example, a double-printed sheet. The guide yoke blowers provided at the upper end of the sheet guide plate can be adjustable concurrently with the braking rollers to ensure that only print-free margins are contacted.

The output of air from the blower nozzles at the lower end of the guide yoke blowers has basically two effects. First, the static partial vacuum created causes the print-free portions of the sheet to contact the guide yokes of the guide yoke blowers. This responsively causes the sheet to be tensed. Second, in the remaining surrounding area, the air streaming out of the blower nozzles increases the air cushion between the sheet guide plate and the underside of the sheet. Therefore, whereas firm contact of the back sheet section on the braking rollers is achieved, the controlled increase in the air cushion also provides an assurance that the images on the underside of the sheet are not smeared at the upper end of the sheet guide plate. The above sheets are also important since the sheet end has passed the blower nozzles when the leading edge of the sheet is released by the gripper members of the chain deliverer. This allows retardation to be set in such a way that the leading edge only slides against the stops of the pile at low velocity.

A further embodiment of the subject invention is the provision of tensioned guide bands located between the braking rollers and the guide yoke blowers and which are adjustable with respect to the braking rollers. Alternatively, a flexible guide cloth can be similarly provided. A further embodiment of the present invention is the provision of easily interchangeable cover plates between adjacent braking rollers which are replaceable with different-sized cover plates when the braking rollers are laterally adjusted.

BRIEF DESCRIPTION OF THE DRAWINGS

The following is a brief description of the invention based upon the accompanying drawings wherein.

DETAILED DESCRIPTION OF THE PREFERRED EXEMPLARY EMBODIMENTS

Figure 1:
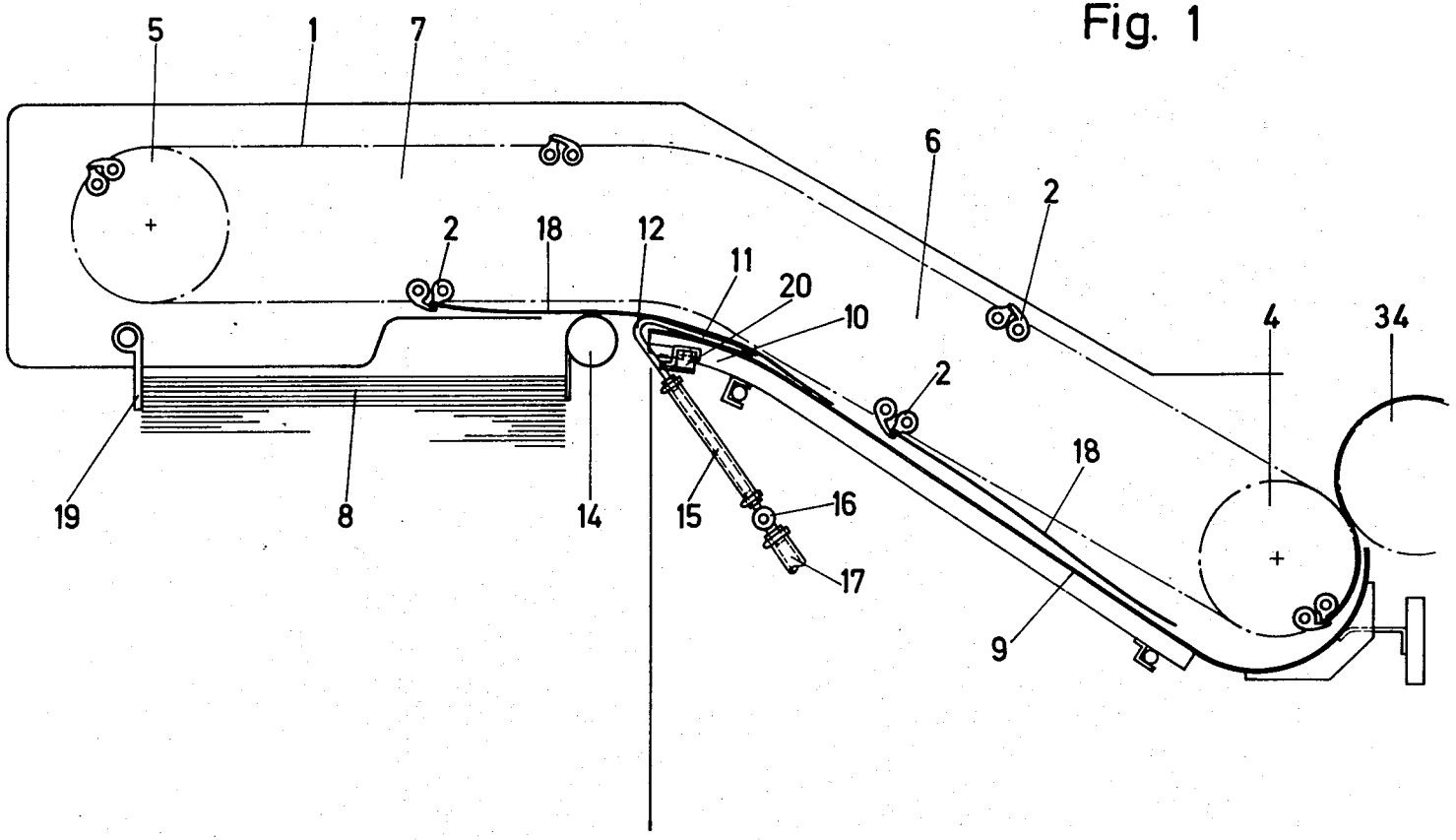
FIG. 1 depicts a side view of an embodiment of a sheet deliverer in accordance with the invention.

The sheet deliverer shown in FIG. 1 includes continuous chains 1 provided with gripper members 2 at symmetrical intervals and guided in side frames 3. Directly after the impression cylinder 34 of the last printing unit of a rotary printing press (not shown) are chain sprocket wheels 4, with further chain sprocket wheels 5 at the end of the sheet deliverer. The continuous chains 1 are driven and guided by chain sprocket wheels 4 and 5. The path covered by chains 1 comprises a rising section 6 starting at the chain sprocket wheels 4 and a horizontally disposed section 7 above the delivery pile 8 into which the rising section 6 merges with a gentle curvature. The horizontal section 7 of the chain path terminates at the chain sprocket wheels 5.

A sheet guide plate 9 is provided below the rising section 6 of the chain path, the lower end of which is directed around the chain sprocket wheels 4 in a position just before the impression cylinder 34. The upper guide plate end 10 is slightly curved, roughly following the curvature of the chain path at the transfer point between the rising section 6 and the horizontal section 7. Several guide yoke blowers 12 distributed across the width of the sheet deliverer are located between the guide plate end 10 and the braking rollers 14, which are located directly upstream of the delivery pile 8.

Figure 2:
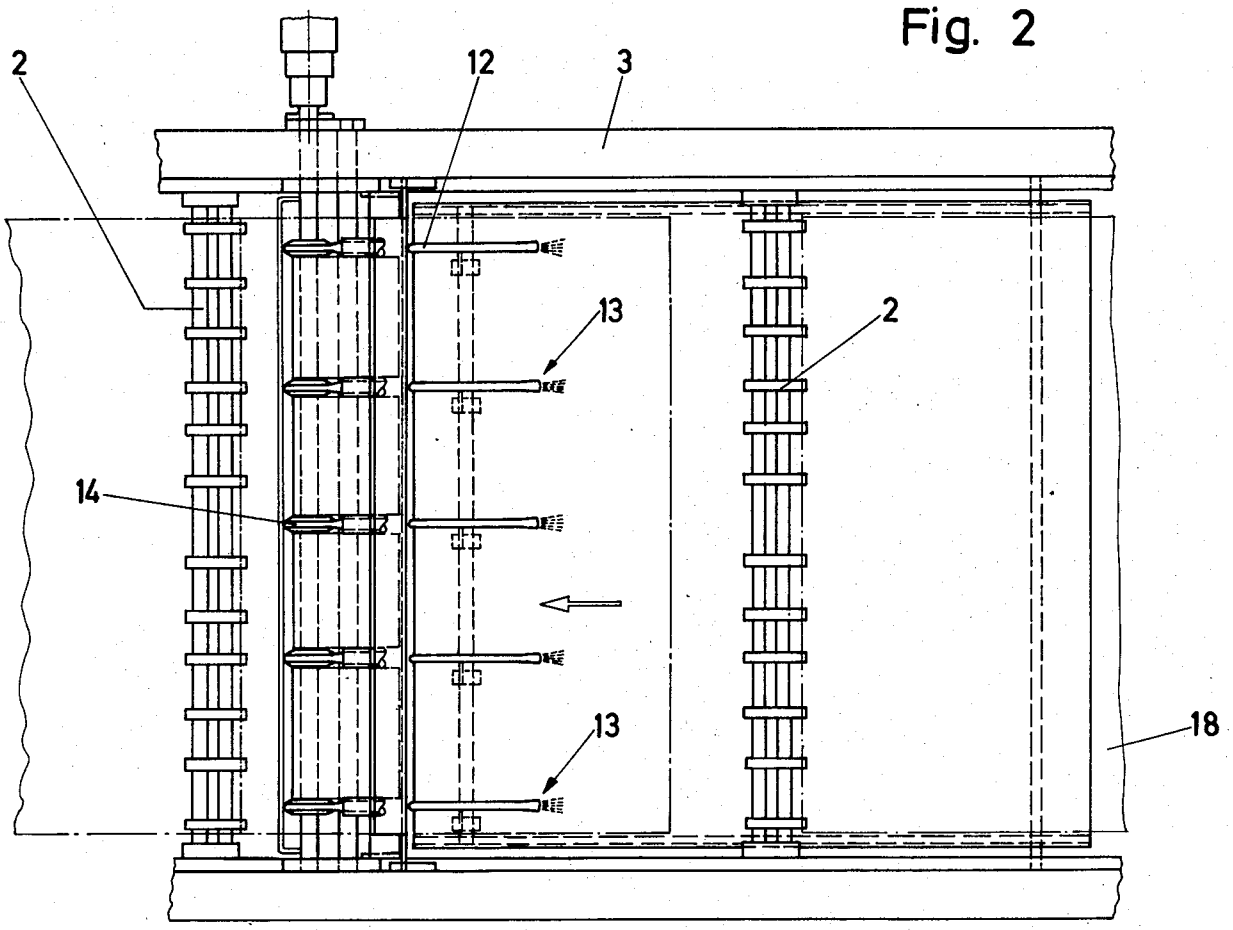
FIG. 2 depicts a top view of the sheet deliverer shown in FIG. 1.

The guide yokes 11 of these guide yoke blowers 12 extend at approximately equidistant intervals above the guide plate end 10 in a direction opposite to the movement of the gripper members 2 and are practically disposed on the surface of the guide plate 9. At the lower end of such guide yoke 11 is a blower nozzle 13, as shown more clearly in FIG. 2. The guide yoke blowers 12 are downwardly directed in the space between the guide plate end 10 and the braking rollers 14 and are connected via hoses 15 to a distributing pipe 16. This distributing pipe 16 is, in turn, connected via a hose 17 to a compressor (not shown).

The gripper members 2 carry the sheet 18 from the impression cylinder 34 and guide it over and away from the guide plate 9. This action automatically leads to the creation of an air cushion between the surface of the guide plate 9 and the underside of the transported sheet 18. Consequently, the sheet 18 does not come into contact with the guide plate 9, rather it floats therealong guided by the gripper members 2.

Since air leaves the blower nozzles 13 of the guide yoke blowers 12, a partial vacuum is created in the area of the guide yokes 11 between the underside of the sheet and the surface of the curved guide plate end 10. This results in the sheet 18 transported by the gripper members 2 being drawn against the guide yokes 11 of the guide yoke blowers 12. An appropriate arrangement of the guide yoke blowers 12 means that only the print-free portions of the sheets come into contact with the guide yokes 11. Contact of the underside of the sheet with the guide yokes 11 causes the sheet to be tensed therefore ensuring that its end is also reliably contacted with the braking rollers 14 downstream. Reliable braking of the sheet 18 transported by the gripper members 2 over the delivery pile 8 is thus ensured. Flicking up of the sheet end at the curvature of the chain path (i.e. at the intersecting portion of rising section 6 and horizontal section 7), cannot occur even at very high sheet conveying speeds. It is, therefore, unnecessary to install blowers to press the sheet end down at such intersecting portion.

The air leaving the blower nozzles 13 not only ensures good contact of the underside of the sheet on the braking rollers 14, but also increases the air cushion between the sheet 18 and the guide plate 9 in the area of the rising section 6. Thus, the sheet guided by the gripper members 2 does not hang down between two guide yoke blowers in the area of the intersection of rising section 6 and horizontal section 7. Smearing of the printed underside of the sheet as a result of contact with the surface of the guide plate end 10 is thus avoided.

The gripper members 2 release the leading edge of each guided and transported sheet above the delivery pile 8. As a result of the good contact of the back sheet end on the braking rollers 14, the sheet is slowed down considerably, meaning that only the leading edge of the sheet slides against the pile stops 19 at low velocity. This ensures that even at high sheet conveying speed, damage to the leading sheet edge is effectively avoided.

Figure 3:
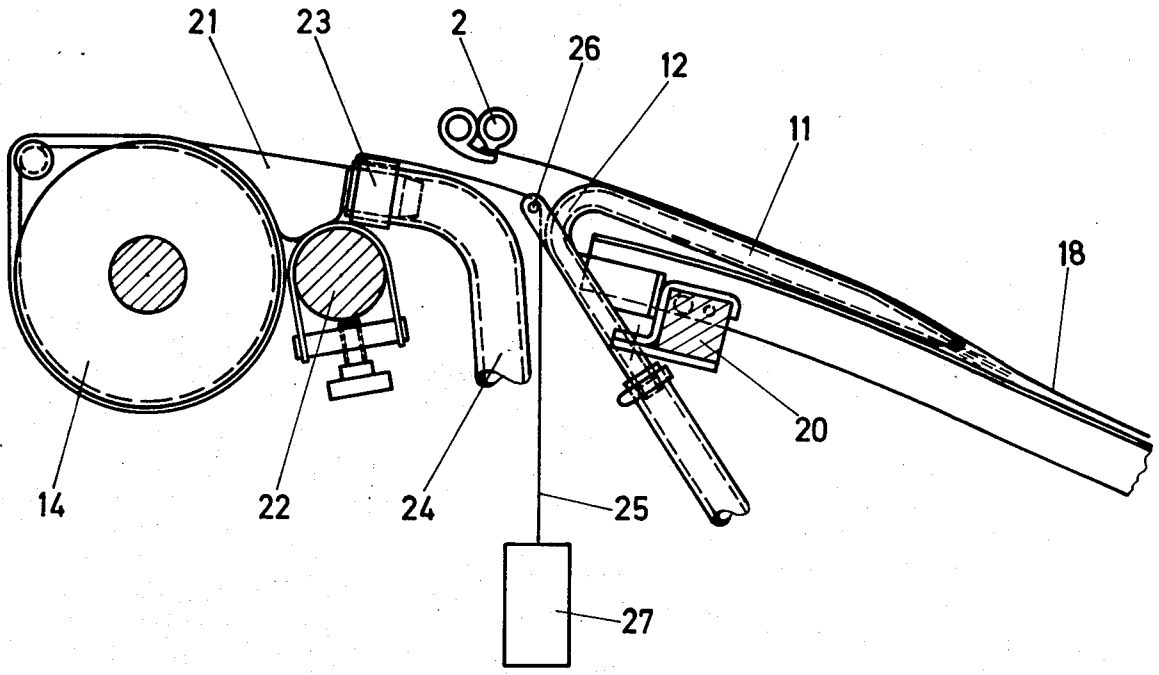
FIG. 3 depicts an arrangement of the guide yoke blowers between the sheet guide plate and the braking rollers.

FIG. 3 depicts the embodiment for laterally adjusting the guide yoke blowers 12 on a transverse member 20 extending across the width of the sheet deliverer. The housing 21 of the braking rollers 14 is similarly mounted on a traverse member 22 and is laterally adjustable thereon. Traverse member 22 is held by the two side frames 3 of the sheet deliverer and can be adjusted toward delivery pile 8. Each housing 21 of the braking rollers 14 is provided with a hose connection 23 and is connected via a hose 24 to a vacuum pump (not shown).

A guide band 25 may be secured to each hose connection 23 of a housing 21 and is disposed from hose connection 23 in the direction of the guide yoke blowers 12.

Guide band 25 is carried over guide bolts 26 attached to the guide yoke blowers 12. The end of guide band 25 is secured to a weight 27, which keeps it taut. When the braking rollers 14 are adjusted in or against the sheet conveying direction, the weight 27 responsively moves up or down, respectively. Guide band 25 which is constantly kept taut in by the weight 27, is used to support the sheet resting against the guide yokes 11 since the air cushion on the underside of the sheet collapses at the end of the guide plate end 10 and no other supporting elements are provided in the area between the guide yoke blowers 12 and the braking rollers 14.

Figure 4:
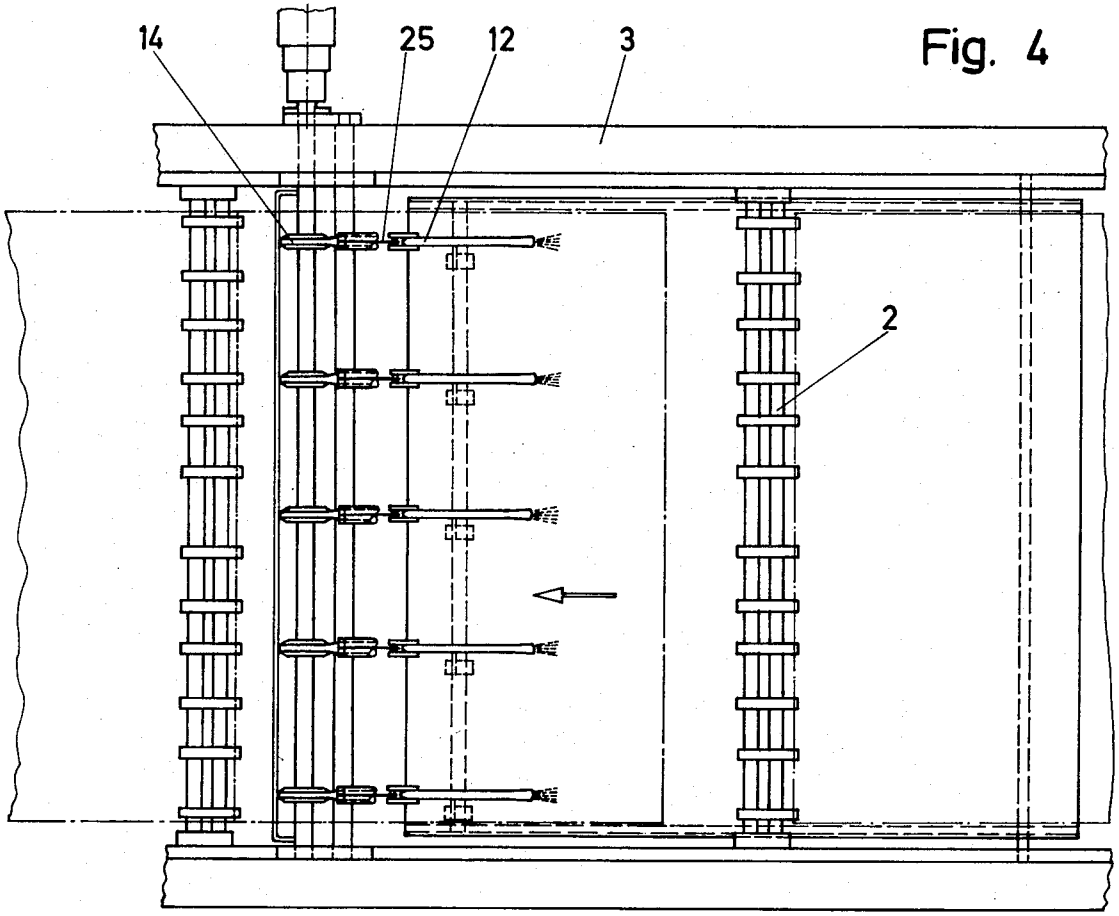
FIG. 4 depicts a top view of the configuration shown in FIG. 3.

Once both the braking rollers 14 and the guide yoke blowers 12 are adjustably set to the print-free areas of the sheet, each guide band 25 will automatically only contact a print-free area as well. This feature can be seen more clearly in FIG. 4, which shows a top view of a sheet deliverer as in FIG. 3. Guide yoke blowers 12 and braking rollers 14 are substantially aligned in succession in the sheet conveying direction. When changing the machine to deal with a different printing product, which is also produced according to the perfecting process, both guide yoke blowers 12 and braking rollers 14 must be adjusted to correspond with print-free areas of the new printed product.

Figure 5:
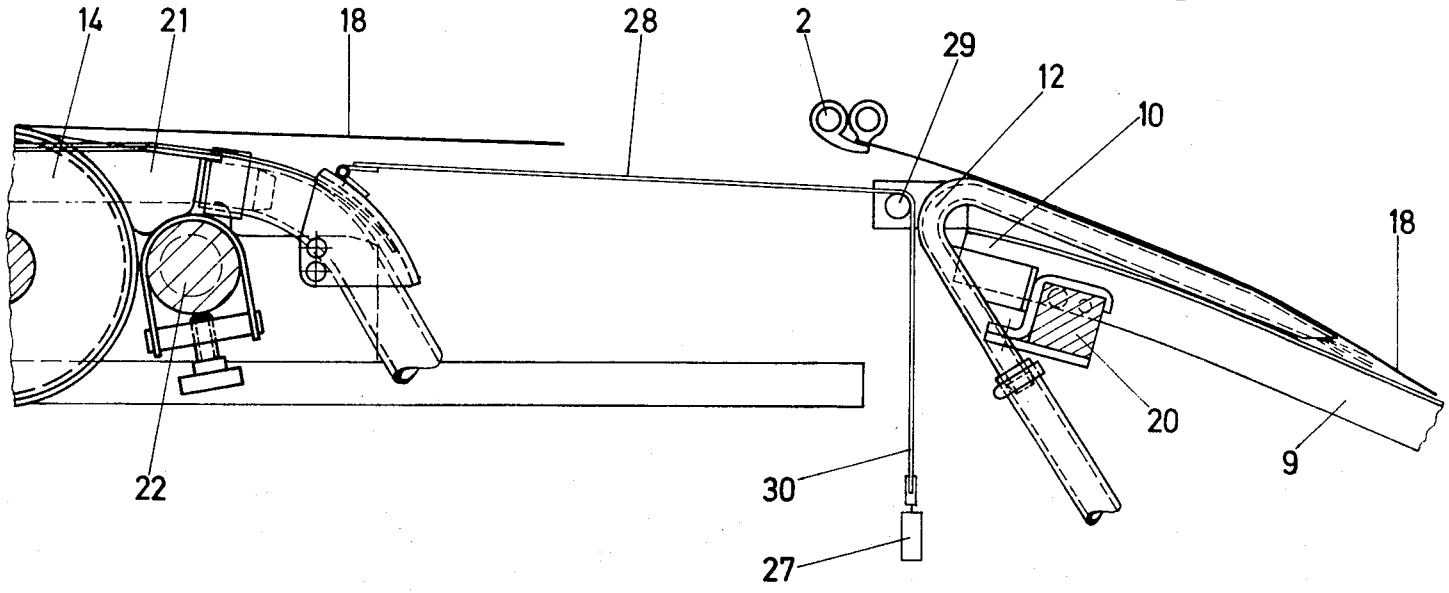
FIG. 5 depicts an embodiment for bridging the space between the guide yoke blowers and the braking rollers by means of a guide cloth.

Instead of the guide bands 25, a guide cloth 28 (as shown in FIG. 5) can be used provided that it is antistatically coated or includes a metal sheet coated thereover. The front end of guide cloth 28 is similarly attached to the housing 21 of the braking rollers 14. It extends as far as a deflecting rod 29, which is positioned just behind the guide plate end 10 and is held taut by a weight 27. In a similar manner as with the guide bands 25, one or several weights 27 are attached to the free end 30 of the guide cloth 28. The guide cloth 28 entirely covers the space between the guide yoke blowers 12 and the braking rollers 14, which space may vary due to extensions in size. The air cushion on the underside of the sheet 18 which forms above the guide plate 9 is maintained by the guide cloth 28. Smearing of the underside of the sheet is, thus, also effectively prevented by means of the guide cloth 28.

Figure 6:
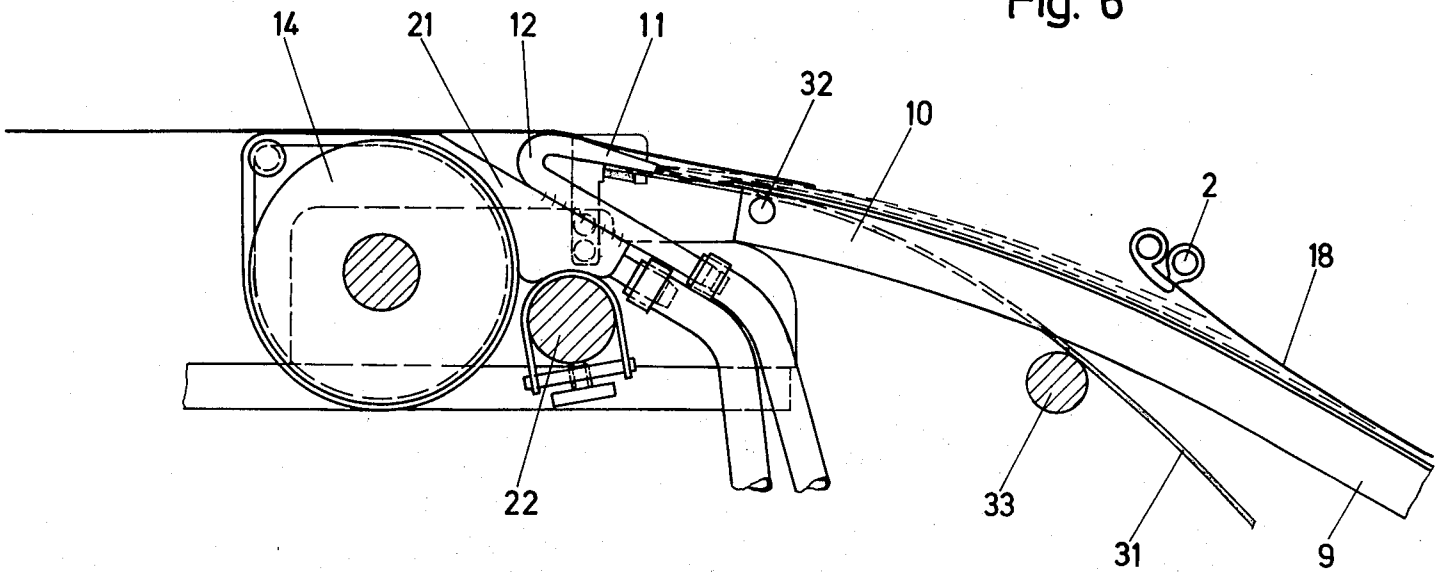
FIG. 6 depicts an embodiment wherein the guide yoke blowers are mounted directly to the housing of the braking rollers.

FIG. 6 shows another embodiment of the invention wherein the guide yoke blowers 12 are directly welded to the housing 21 of the braking rollers 14. A flexible guide plate 31 is provided instead of a guide cloth 28. The front end of guide plate 31 is connected to the housing 21 of the braking rollers 14. Guide yokes 11 of the guide yoke blowers 12 extend in this embodiment over the front end of flexible guide plate 31. Two traverse members 32, 33 are positioned under the sheet guide plate 9 and serve to support and guide flexible guide sheet 31. Traverse member 32 is arranged so that there is practically no gap between the surface of the flexible guide plate 31 and the lower edge of the guide plate end 10. When the braking rollers 14 are adjusted in the direction of the delivery pile 8, the flexible guide plate 31 is pulled out from under the curved guide sheet end 10 thus providing a continuation of the sheet-guiding surface of sheet guide plate 9. It is therefore easy to jointly adjust the connected braking rollers 14 and guide yoke blowers 12 both laterally and in or against the sheet conveying direction. Since the guide yoke blowers 12 are fitted directly upstream of the braking rollers 14, the sheet is applied with great force against braking rollers 14.

Figure 8:
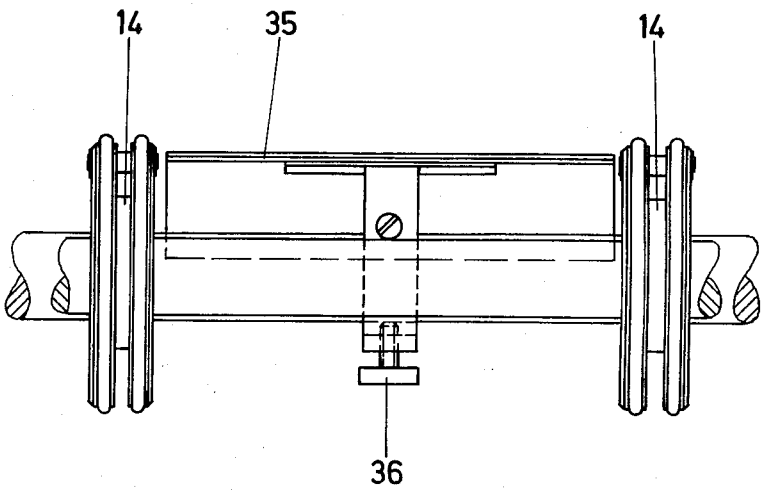
FIG. 8 depicts a front view of the cover plate embodiment shown in FIG. 7.
Figure 7:
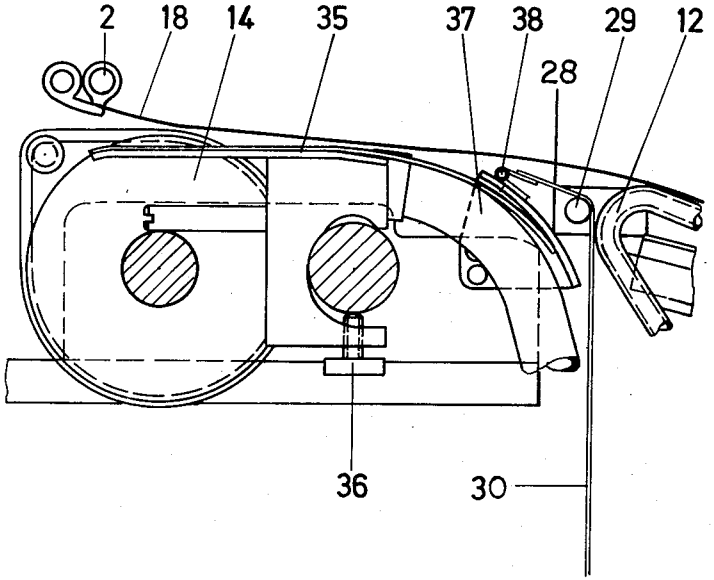
FIG. 7 depicts a side view of the embodiment of a cover plate disposed between adjacent braking rollers.

The effect of the largely undisturbed print achieved with sheet delivery by means of a sheet deliverer according to the present invention can be increased further by providing cover plates 35 between the individual braking rollers 14 as shown in FIGS. 7 and 8. Cover plates 35 can be mounted so that they are easily removable and interchangeable by a clamping fixture 36 on traverse member 22 for the braking rollers 14. When the braking rollers 14 are laterally adjusted, the existing cover plate 35 can be removed and exchanged for another cover plate which fits the adjusted space between adjacent ones of braking rollers 14.

The end of the cover plates 35 facing the guide yoke blowers 12 protrudes into a curved guide 37, which, together with the traverse member 22, is adjustably mounted on the side frames 3 in the direction of the delivery pile 8. A mount 38 joins the flexible guide cloth 28 to the guide 37 mentioned. The flexible guide cloth 28 is directed vertically downwards by a deflection rod 29 located directly downstream of the guide yoke blowers 12 and the free end 30 is thus held taut by a weight (not shown) in a manner similar to that described above with regard to FIG. 5.

The embodiment of the present invention shown in FIGS. 7 and 8 allows the air cushion forming above the guide plate 9 during sheet transportation to be maintained as far downstream as the level of the braking rollers 14 since the cover plates 35 extend the continuous guide surface thereby preserving the air cushion as far as the braking rollers 14. In addition to reliable contact of the sheet underside on the braking rollers 14 as a result of the effect of the guide yoke blowers, the continuation of the sheet guidance surface results in a smooth sheet delivery.

The guide yoke blowers 12 could, of course, also be usefully employed on straight running sheet deliverers. The chain path would then only comprise a horizontal section, starting at the chain sprocket wheels 4 and extending over the delivery pile 8.

While the present invention has been herein described in what is presently conceived to be the most preferred embodiments thereof, it will be appreciated that those in the art may make modifications thereto upon a detailed reading of this disclosure, which modifications should be accorded the broadest interpretation of the appended claims so as to encompass all equivalent assemblies, devices, or structures.

What is claimed is:

1. A sheet deliverer adapted for sequentially transporting sheets having printed portions at least on the undersides thereof and print-free margins defining said printed portions from a rotary printing machine to means defining a product collection site, said sheet deliverer comprising in combination:

continuous means for sequentially transporting said printed sheets from said rotary printing machine to said product collection means thereby defining a path of conveyance of said sheets therebetween, said transporting means including gripping means for gripping the leading edge portion of said printed sheets as each of said printed sheets leaves said rotary printing machine and for releasing said printed sheets over said product collection means, said transporting means having at least one section extending substantially horizontally over said product collection means;

plate means disposed below said transporting means thereby defining a space through which said printed sheets are conveyed, said plate means having a downstream end portion terminating upstream of said product collection means and being transversely oriented relative to said path of conveyance, wherein an air cushion is developed between the underside of said sheets and said plate means upon the conveyance of said sheets by said transporting means, said air cushion at least partially supporting said sheets above said plate means;

a plurality of elongated guide yoke means defining a conduit through which blown air can pass, said guide yoke means being disposed along said downstream end portion substantially equally spaced relative to each other therealong, each of said guide yoke means being oriented in a direction opposite to said path of conveyance so that said blown air is directed opposite to the direction of said path of conveyance;

adjustment means for transversely adjusting said guide yoke means so that said guide yoke means only contacts said printed sheets along the print-free margins thereof; and a plurality of braking means downstream of said guide yoke means, each of said guide yoke means being paired with a predetermined one of said braking means, said braking means for contacting said printed sheets at the print-free margins thereof and for reducing the velocity of conveyance of said printed sheets so that upon release of said leading edge portion by said gripping means, said printed sheets will be deposited into said product collection means;

said guide yoke means, by virtue of said blown air, for (a) creating a partial vacuum along said downstream end portion of said plate means to cause said sheets to be drawn against said guide yoke means to thereby cause a trailing edge of said sheet to contact said braking means and (b) supplementing said developed air cushion to support said sheets above said plate means to prevent contact between said conveyed sheets and said plate means.

2. A sheet deliverer as in claim 1 further comprising means for reciprocably adjusting said braking means relative to said path of conveyance.

3. A sheet deliverer as in claim 2 further comprising a plurality of guide band means each being responsively carried with predetermined ones of said braking means for spanning the space defined between said pairs of braking and guide yoke means, said guide band means contacting said printed sheets only at the print-free margins thereof.

4. A sheet deliverer as in claim 3 wherein said guide band means includes tensioning means for maintaining said band means under tension.

5. A sheet deliverer as in claim 4 wherein said tensioning means includes means for securing one end of said guide band means to said braking means, weight means fixedly attached to the opposite end of said guide band means, and means intermediate said one end and said other end for supporting said guide band means in the tensioned state between said braking and said guide yoke means.

6. A sheet deliverer as in claim 2 further comprising guide cloth means having a width as measured transverse to said path of conveyance at least as wide as the width of said printed sheets for spanning the space defined between said pairs of braking and guide yoke means, said guide cloth means being responsively carried with said braking means.

7. A sheet deliverer as in claim 6 wherein said guide cloth means includes an antistatic coating thereon.

8. A sheet deliverer as in claim 6 wherein said guide cloth means includes a metal sheet coated thereover.

9. A sheet deliverer as in claim 1 further comprising means for rigidly attaching said pairs of braking and guide yoke means to one another.

10. A sheet deliverer as in claim 9 wherein said braking means includes reciprocable adjusting means for reciprocably adjusting said braking means in a direction along said path of conveyance.

11. A sheet deliverer as in claim 9 or 10 wherein said braking means includes transverse adjusting means for adjusting said braking means transverse to said path of conveyance.

12. A sheet deliverer as in claim 11 further comprising flexible guide sheet means for spanning the space between said downstream end and said guide yoke means when said pairs of braking and guide yoke means are adjusted in the direction of said path of conveyance.

13. A sheet deliver as in claim 1, 2 or 3 further comprising cover means disposed between adjacent pairs of said braking and guide yoke means, and means for removably attaching each said cover means between respective said adjacent pairs of said braking and guide yoke means to permit varying sizes of said cover means to be disposed between said adjacent pairs of said braking and guide yoke means upon transverse adjustment thereof.

14. A sheet deliverer as in claims 1, 2, 3, 4 or 5 wherein said transporting means further has a second section upstream of said first mentioned section upwardly inclined in the direction of said path of conveyance.

15. A sheet deliverer as in claim 14 wherein said plate means is disposed below said second section.

16. A sheet deliverer as in claim 15 wherein said guide yoke means are angularly and downwardly oriented to said path of conveyance.

* * * * *